US008672412B2

(12) United States Patent
Opsvik

(10) Patent No.: US 8,672,412 B2
(45) Date of Patent: Mar. 18, 2014

(54) FASTENING DEVICE FOR A CHAIR

(75) Inventor: Peter Opsvik, Oslo (NO)

(73) Assignee: Peter Opsvik AS (NO)

( * ) Notice: Subject to any disclaimer, the term of this patent is extended or adjusted under 35 U.S.C. 154(b) by 567 days.

(21) Appl. No.: 12/936,377

(22) PCT Filed: Mar. 31, 2009

(86) PCT No.: PCT/NO2009/000121

§ 371 (c)(1),
(2), (4) Date: Dec. 21, 2010

(87) PCT Pub. No.: WO2009/123470

PCT Pub. Date: Oct. 8, 2009

(65) Prior Publication Data

US 2011/0101753 A1 May 5, 2011

(30) Foreign Application Priority Data

Apr. 3, 2008 (NO) ..... 20081658

(51) Int. Cl.
*A47C 31/00* (2006.01)

(52) U.S. Cl.
USPC ..... 297/463.1; 297/467; 297/463.2; 24/458

(58) Field of Classification Search
USPC ..... 297/467, 463.2, 463.1; 24/458
See application file for complete search history.

(56) References Cited

U.S. PATENT DOCUMENTS 3,563,600 A * 2/1971 Converse ..... 297/254
3,713,692 A * 1/1973 McCracken et al. ..... 297/467
3,863,303 A * 2/1975 Armstrong et al. ..... 24/193
4,602,760 A * 7/1986 Tiefenbach et al. ..... 248/544
4,685,741 A * 8/1987 Tsuge et al. ..... 297/467
5,060,976 A * 10/1991 Boone ..... 280/801.1
5,413,377 A * 5/1995 Kamiyama et al. ..... 280/733

(Continued)

FOREIGN PATENT DOCUMENTS

CN 1346617 A 5/2002
CN 1347676 A 5/2002

(Continued)

OTHER PUBLICATIONS

Nilsson, Lena, Authorized officer, Swedish Patent Office/International Searching Authority, PCT Application No. PCT/NO2009/000121; International Search Report: search completion date: Jun. 4, 2009; mailing date: Sep. 6, 2009.

(Continued)

*Primary Examiner* — David E Allred
(74) *Attorney, Agent, or Firm* — Kolisch Hartwell, P.C.

(57) ABSTRACT

The present invention concerns a fastening device for use in a children's chair (40) with a seat plate (41), wherein the seat plate has a vertical through hole, characterized in that a cross piece (1) connected to two side pieces (2) which are joined by a cross bar (3) and defining an opening (6), wherein the cross bar (3) is positioned in a vertical distance from the cross piece (1) when the fastening device is mounted; two mainly vertical lining elements (4) to be inserted into the hole, connected to the underside of the cross piece (1) and/or side pieces (2) in their upper ends, wherein the lining elements (4) each comprise at least one locking hook 5 in their lower ends which have a larger horizontal extent than the lining elements.

25 Claims, 3 Drawing Sheets

(56) References Cited

U.S. PATENT DOCUMENTS

| | | | | | |
|---|---|---|---|---|---|
| 5,816,662 | A * | 10/1998 | Rumburg | 297/484 |
| 5,839,793 | A * | 11/1998 | Merrick et al. | 297/484 |
| 5,873,635 | A * | 2/1999 | Merrick | 297/484 |
| 5,951,112 | A * | 9/1999 | Hansson | 297/482 |
| 6,324,732 | B1 * | 12/2001 | Arisaka et al. | 24/458 |
| 6,334,750 | B1 * | 1/2002 | Hsieh | 411/508 |
| 6,513,205 | B1 * | 2/2003 | Mathieu | 24/458 |
| 6,588,849 | B2 * | 7/2003 | Glover et al. | 297/467 |
| 6,857,430 | B2 * | 2/2005 | Morris | 128/869 |
| 6,868,588 | B2 * | 3/2005 | Dickinson et al. | 24/295 |
| 7,178,205 | B2 * | 2/2007 | Nessel et al. | 24/289 |
| 7,510,245 | B2 * | 3/2009 | Okazaki et al. | 297/483 |
| 7,744,163 | B2 * | 6/2010 | Opsvik | 297/467 |
| 8,240,765 | B2 * | 8/2012 | Kennedy et al. | 297/338 |
| 2002/0083565 | A1 * | 7/2002 | Papp | 24/458 |
| 2003/0037418 | A1 * | 2/2003 | Lenhart et al. | 24/458 |
| 2006/0082199 | A1 * | 4/2006 | Dingman et al. | 297/250.1 |
| 2009/0079141 | A1 * | 3/2009 | Qiang et al. | 277/650 |
| 2009/0134689 | A1 * | 5/2009 | Opsvik | 297/467 |

FOREIGN PATENT DOCUMENTS

| | | | | |
|---|---|---|---|---|
| DE | 10229436 | A1 | 1/2004 | |
| EP | 0 747 257 | A1 | 12/1996 | |
| JP | 63038057 | A * | 2/1988 | B60R 22/12 |
| WO | 2007/097637 | A2 | 8/2007 | |
| WO | 2007/097638 | A2 | 8/2007 | |
| WO | 2007097637 | A2 | 8/2007 | |
| WO | 2007097638 | A2 | 8/2007 | |
| WO | WO 2007097637 | A2 * | 8/2007 | A47D 15/00 |
| WO | 2009123470 | A1 | 10/2009 | |

OTHER PUBLICATIONS

Nilsson, Lena, Authorized officer, Swedish Patent Office/International Searching Authority, PCT Application No. PCT/NO2009/000121; Written Opinion of the International Searching Authority: mailing date: Sep. 6, 2009.

Patent Examination Cooperation Center of the Patent Office, Jiangsu, "Office Action" in connection with related Chinese Patent Application No. 200980112095.3, dated Jan. 16, 2013, 4 pages.

Mohd Amirulhaizad Bin Ab Wahab, Patent Examiner, Intellectual Property Corporation of Malaysia, "Substantive Examination Adverse Report (Section 30(1)/30(2))" in connection with related Malaysian Patent App. No. P12010004429, dated Sep. 13, 2013, 3 pages.

* cited by examiner

FASTENING DEVICE FOR A CHAIR

The present invention concerns a fastening bracket for a chair, such as a children's chair with a seat plate, wherein the seat plate has a vertical hole in the front edge. The invention is especially suitable for a chair having the possibility for vertical and horizontal adjustment of the seat plate. Further, the invention concerns a harness and seating rail set for the fastener bracket and the use of the fastening bracket and the set.

BACKGROUND OF THE INVENTION

It is well known that small children, that is children such as from the age when they may sit by themselves (about 6-7 month) until they master sitting safely in a children's chair without falling out (about 2 years), need harnesses securing them sitting safely in children's chairs.

Often, conventional harnesses are used, such as those accompanying a children's pram, a children's chair of which may be bought separately. In new children's chairs the harnesses are often anchored by straps on each side of the seat in integrated fastening means, such as eyes or similar. Such harnesses have the disadvantage that they require integrated fastening means in the chair and also hinder the child in turning the upper body to the side because the straps on each side of the harness must be relative short. This short length of the straps is to secure that the child sits safely in the chair, but this hinders and generally irritates the child.

In later years, a development has evolved in the direction of more countries and regions having their own safety requirements and regulations for equipment to be used for children, such as for children's chairs and harnesses. This must continuously be taken into account in the development of new children's chairs, but it may be difficult to adapt chairs which have been produced for a long time, before such safety regulations were put into force. It is especially difficult to perform such adaptation without making physical interventions in the chairs.

This is for example the case with the Tripp Trapp® children's chair which was developed as early as in 1972 and patented in 1976 and which still is a very popular children's chair in many countries.

The chair is designed to be adjusted in coherence with the growing body size of the child and therefore has a seat plate and a foot plate which may be moved into different height positions by gliding into tracks distributed upward along the length of the side pieces and being locked by tightening the distance between the side pieces. The sitting plate may further be adjusted in the depth position by the plate being pushed in and out (forward and backward) in relation to the back rest, and thereby providing the child using the chair, a correct seat length under the thighs.

It has proven difficult to adapt existing seats to new effective requirements, especially in order to retain the above-mentioned original functions of the chair. In order to achieve this, the fastening or fasteners for a children's harness should be able to follow the height position of the seat.

In addition to fastening a harness to such chairs, it may also be desirable to be able to mount a children's seating rail, which either may be used alone or simultaneously with the harness.

It is a further objective to provide a fastening means for this additional equipment so that also owners of older chairs may upgrade their chairs. As mentioned, it is also an objective to avoid physical intervention in the chair, such as making holes in any of the parts or inserting screws that leave spoiling marks in the chair, which will be visible when there no longer is use for the children's equipment. Moreover, such adaptations involve a risk of the user making adaptations in the wrong manner, and that the safety is not kept intact. It is therefore an objective of the invention to make the fastening of the children's equipment as intuitive and simple as possible, and upholding the safety at the same time.

NO 323899/WO 2007/097637, Peter Opsvik AS, shows a fastening bracket for use in a seat plate with a vertical hole in a children's chair of the type mentioned above. The bracket comprises a fastening means with a slit for placing on the underside of the seat plate, and a lining clip with vertical locking pegs which are guided through the hole in the seat plate from the top side and which is locked on the top side of the seat plate by a flange which is larger than the hole. The locking pegs have horizontal holes wherein a locking pin is inserted for locking the fastening device to the lining clips on the underside of the seat plate. The fastening device may in addition comprise an edge slit protruding in front of the seat plate for insertion of a part of a children's seating rail.

In order to secure that the fastening of equipment as mentioned above is carried out in a correct manner, and that it is intuitive, it is a further objective to limit the number of parts to reduce the possibility for such parts being installed wrongly. A few number of parts also reduces the possibility for individual parts to be lost during storage of the equipment, such as in-between periods when the equipment is not used, for later to be brought out when for example the next child is grown enough to sit in a children's chair. In such periods, there is also the chance that the original user guide disappears.

Faulty installation is often a consequence of the user not reading the user guide or not understanding the user guide, it may be that the language and/or the illustrations for installation are difficult to understand, or that the user guide has disappeared. It is therefore an objective to reduce the possibility of installing the equipment in a manner that seemingly may be perceived as correct for the consumer, or as a possible alternative installation manner, but which in use will not tolerate the loads that the equipment is meant to be exposed to.

Further, it is an objective to obtain a fastening device which is small, discrete and less bothersome for the user, both physically and ecstatically. At the same time, such a fastening device should not protrude outside of the outer edges of the chair both to hinder that it absorbs impact and is damaged if the chair for example is tipped over and to allow a cushion with a pocket in the frontal edge to be installed in the chair, wherein the pocket is thread over the entire front edge of the chair.

DESCRIPTION OF THE INVENTION

In order to achieve these objectives the applicant has developed a fastening bracket for the fastening of children's equipment which solves the above mentioned problems. The bracket may be part of a harness set and/or seating rail set particularly adapted for use in a children's chair.

The bracket consists of one single fastening device with a bow, which is entered into the hole in the seat plate from the topside and which allows for a part of a children's harness to be thread through the bow and/or that a part of the children's seating rail to be inserted down into and fastened in the fastening device.

Thus, the present invention concerns a fastening bracket, a harness set, as well as the use of this according to the appended claims and according to the aspects given below.

In one aspect, the invention provides for a fastening device for use in a children's chair with a seat plate, wherein the seat plate has a vertical through hole for the mounting of the fastening device, characterized in that the fastening device comprises: at least one cross piece connected to two side pieces which are joined by at least one cross bar and defining an opening, wherein the cross bar is positioned in a vertical distance from the cross piece when the fastening device is mounted; and at least two mainly vertical lining elements to be inserted into the hole, connected to the underside of the cross piece and/or side pieces in their upper ends, wherein the lining elements each comprise at least one locking hook in their lower ends which have a larger horizontal extent than the lining elements.

In another embodiment at least parts of the mentioned cross piece and the mentioned side pieces comprise a contact surface on the underside of the pieces to bear against the top side of the seat plate, preferably an open or closed continuous contact surface, even more preferably a contact surface stretching in a half circle around the outer sides of the lining elements.

In a further embodiment the fastening device allows for insertion of a part of a children's seating rail, preferably a crotch strap, through the opening when the fastening device is mounted in a seat plate, preferably an extremity with a snap flap which flips out on the underside of seat plate to which the fastening device is attached; and/or the fastening device allows a part of a children's harness, preferably a crotch strap, to freely run around the cross bar when the fastening device is mounted in a seat plate, preferably simultaneously with a part of a children's seating rail being fastened through the fastening device.

In one embodiment the locking hooks are directed partly towards each other, preferably about 45 degrees in relation to the length and/or transverse direction of the fastening device, and in another embodiment each lining element (14) comprises two locking hooks, preferably directed towards each other, more preferably about 45 degrees in relation to the length and/or transverse direction of the fastening device. In an alternative embodiment each lining element comprises flexible zones with reduced rigidness to allow torsion and/or bending of the locking hooks, such as wherein the reduced rigidness is achieved by countersinks present in the lining elements, and/or by the complete or part of the lining elements comprising a more flexible material than the rest of the fastening device. In one embodiment the locking hooks are locked by inserting a part of a seating rail through the opening of the fastening device.

In a further embodiment the side pieces have an increasing height from the cross piece towards the cross bar, preferably that they are wedge formed.

In a second aspect, the invention provides for a harness set for a children's chair having a back rest and seat plate with a vertical hole in the front edge, characterized in that it comprises the fastening device according to any of the above and a children's harness comprising a crotch strap which may be anchored in the fastening device, and preferably a back strap running around at least one cross piece of the back rest in the children's chair it is fastened to.

In a third aspect, the invention provides for a seating rail set for a children's chair having a back rest and seat plate with a vertical hole in the front edge, characterized in that it comprises the fastening device according to any of the above and a children's seating rail with a crotch strap which may be anchored to the seat plate via an extremity which may be guided through the opening in the fastening device and the hole in the seat plate, the extremity preferably having a snap flap which flips out on the underside of the seat plate and the children's seating rail more preferably having end pieces which may be inserted into slits in the side pieces of the chair.

In a fourth aspect, the invention provides for a combined harness and seating rail set comprising the sets above.

In a fifth aspect, the invention provides for the use of a fastening device according to any of the above, or a set according to any of the above, for mounting a harness and/or a seating rail in a children's chair wherein the seat plate has a vertical hole and wherein the chair has the possibility of vertical and horizontal adjustment of the seat plate.

The invention will in the following be described in greater detail by the help of the examples of embodiments and the appended figures, none of which are meant to limit the scope of the invention.

SHORT DESCRIPTION OF THE DRAWINGS

DETAILED DESCRIPTION

In the description to follow the following words and terms should be understood as follows:

By "front", "front side" or "foremost" is meant the horizontal direction which the face and chest of a child sitting in a chair in an ordinary manner is facing towards; and By "behind", "rear" or "at the back of" is meant the opposite horizontal direction, that is the direction towards which the back of a child sitting in a chair in an ordinary manner is facing towards.

By "traverse" side or direction is meant the horizontal direction perpendicular to the symmetrical plane through the chair; and By "length", "depth" or "length direction" is meant the horizontal direction in the symmetrical plane of the chair.

The terms "cross piece" and "side pieces" are not to be understood as linear straight or individual elements that necessarily are separate pieces joint together in clear joints, but rather as elements that have the same functions as the named pieces, and which may have a smooth or progressive junction between them.

Figure 1:
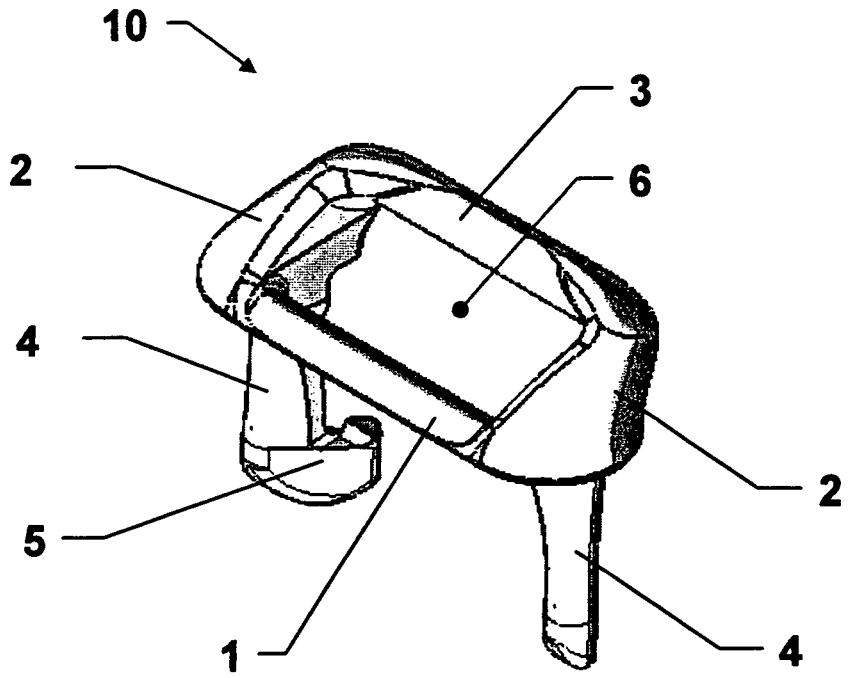
FIG. 1 shows a perspective view of a first embodiment of the fastening device seen from above.

In FIG. 1 fastening device 10 is shown in perspective from above, i.e. from the side of which the top side of the seat plate is directed towards and from the front side of the chair. The fastening device 10 has in this embodiment a flange in shape of a rounded rectangular or trapezoid shape with a front cross piece 1, two wedge-shaped side pieces 2 and a rear upper cross bar 3. From the flange, two parallel lining elements 4 protrude downward from the underside of the side pieces, having locking hooks 5 in their lower ends. The flange surrounds an opening 6 where one end of a crotch strap or a strap from a children's seating rail may be inserted.

The shape of the fastening device and flange, is not limited by the present embodiment of a rectangular or trapezoid shape, and may of course have any suitable form, such as an oval, circular, polygonal shape or any shape therein between, included any rounded form, which also applies to the cross piece and side pieces thereof.

Figure 2:
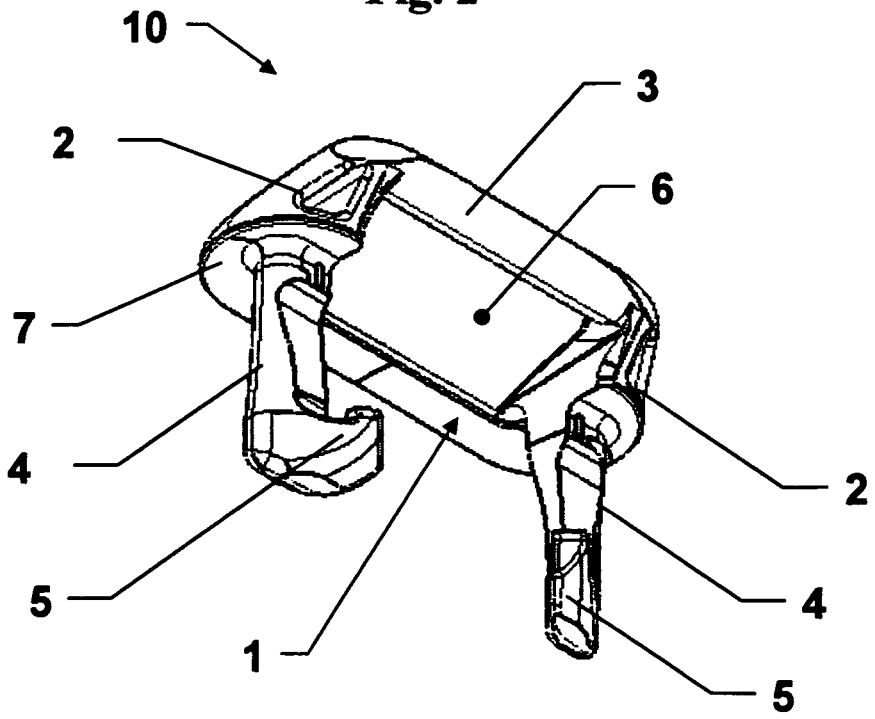
FIG. 2 shows a perspective view of the fastening in FIG. 1 seen from below.

In FIG. 2 the fastening device 10 is shown from below. As may be seen the front crosspiece 1 has a flat underside which makes up a part of a contact surface 7 which should bear against the top side of a seat plate. The contact surface 7 stretches from the front cross piece 1 and further out to the sides of the cross piece and on the underside of the side pieces 2, around the outside of the lining elements 4 wherein they are fastened to the side pieces 2. The contact surface 7 thus forms two half circles facing each other about the lining elements 4, wherein the half circles are joined by the front cross piece 1 and together form a stable flange when the fastening device is strapped down to the underside of the seat plate by the locking hooks 5. As may be seen in FIG. 2, the rear cross bar 3 is in a vertical higher position compared to the contact surface 7, so that a strap may run around the cross bar and through the opening 6, in order to fasten a children's harness to the seat plate.

Figure 3:
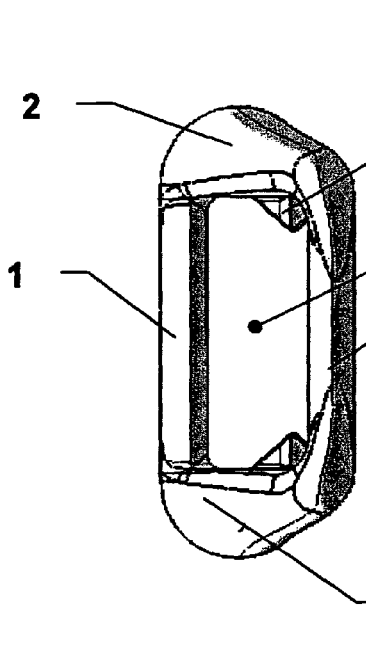
FIG. 3 shows a planar view of the fastening in FIG. 1 seen from above.

In FIG. 3, the fastening device 19 is seen directly from above and the rounded trapezoidal form of the device of this embodiment as well as the opening 6 is especially visible. As may be seen form this angle, the two locking hooks 5 partly protrude out into the opening 6, and these surfaces together with the rest of the horizontal top surface of the locking hooks 5, will after mounting through a hole in the seat plate, bear against the underside of the seat plate.

Figure 4:
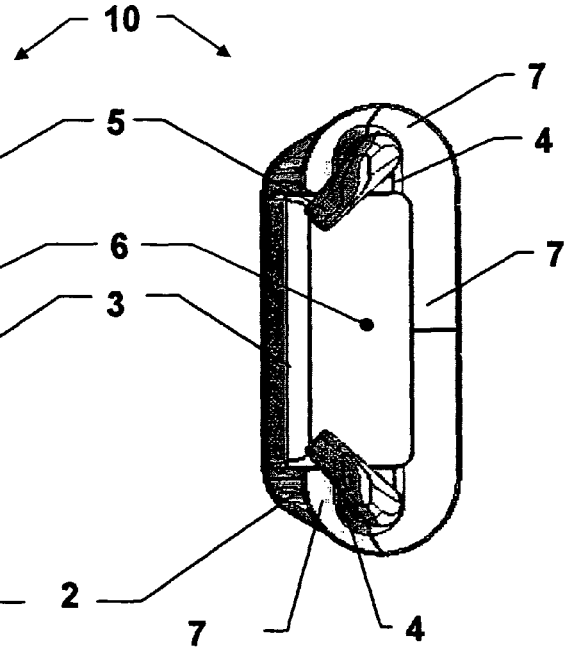
FIG. 4 shows a planar view of the fastening in FIG. 1 seen from below.

In FIG. 4 the fastening device 10 is seen directly from the underside. The locking hooks 5 will during mounting be twisted towards each other so that they may be guided through an oblong shaped hole in the seat plate, such as an oblong rounded rectangular hole, and will flip back into the position show in the figure as the hooks exit on the underside of the seat plate. The hole in the seat plate will in this embodiment typically have a form and extent which follows the transition between the contact surface 7 and the lining elements 4 as they appear in the figure.

Figure 5:
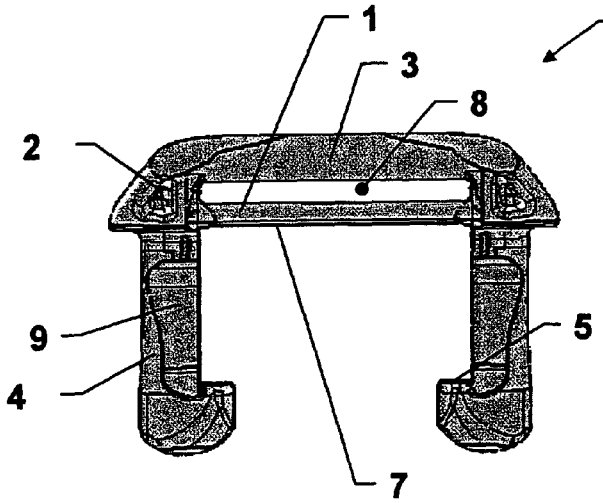
FIG. 5 shows a side view of the fastening in FIG. 1 seen from the rear.

In FIG. 5 the fastening device 10 is seen directly from behind as the upper cross piece 3 is totally visible and the front crosspiece emerges behind the side pieces 2. From this angle the vertical distance between the front 1 and rear 3 cross pieces appears clearly as well as the vertical opening 8 between the lower edge of the rear cross piece 3 and the upper surface of the seat plate (against the contact surface 7) when the device is attached to a seat plate. I this embodiment the horizontal opening 8 is the same as the vertical opening 6 mentioned above, but this needs not be the case, for example if a third cross piece is introduced in parallel with the front cross piece, in the same vertical position, to join together the contact surface 7 on the rear side of the side pieces 2 and lining elements 4. Precisely because there is no such third cross piece in the present embodiment, it is possible to minimize the height of the rear cross piece 3 at the same time as sufficient space is provided for guiding a harness part, such as a crotch strap of a children's harness, around the cross piece, without the fastening device being of hindrance for the user.

Figure 6:
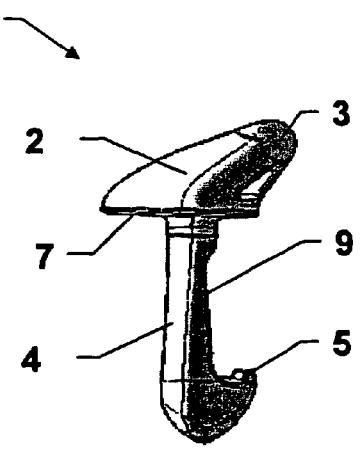
FIG. 6 shows a side view of the fastening in FIG. 1 seen from the (left) side.

In FIG. 6, the fastening device is shown directly from the left side and as above, the vertical positions of the elements are apparent. As may be seen, the contact surface 7 has a relative broad extent in relation to the hole, through which the lining elements 4 are to be guided through, wherein the hole typically will have a dimension close to that of the width of the base on the lining elements for a wobble free fastening. Further, it may be seen that the rear cross piece 3, in addition is positioned in a horizontal distance behind the lining elements 4, which may receive a part of a seating rail piece part between each other, in front of the rear cross piece 3.

A flexible zone 9 in the lining elements 4 also appears in FIGS. 5 and 6 on the same side as the locking hooks 5, but higher up on the elements. The flexible zone 9 in this embodiment, constitutes a countersink in the elements where the rigidity of the lining elements is reduced in order to allow torsion and/or bending of the elements as the locking hooks may be twisted and/or bent in towards each other in order to enter the oblong hole in the seat plate. The form and position of the flexible zone may vary depending on the desired flex resistance and flex direction and the zones may possible be constituted of a different material in the lining elements and/or locking hooks, in stead of a countersink, all according to what is desired to achieve.

From the FIGS. 4-6 the extent of the locking hooks 5 both in the transverse and length direction is also apparent. In this embodiment, the hooks are pointed backwards towards each other in about 45 degrees in relation to the transverse and length directions, but this may vary according to the desired appearance and need for fastening. The shaping is in this embodiment adapted to allow the insertion of an extremity of a children's seating rail into the fastening device from the top side and down through the opening 6, which at its front side will bear against the front cross piece 1. The extremity of the children's seating rail preferably has a snap flap which by complete insertion in the hole of the seat plate and fastening device will flip out on the underside of the seat plate and lock it to the plate. The top side of the locking hooks 5 are horizontal and planar in order to bear against the underside of the seat plate.

The upper part of the extremity of the children's seating rail will have a contact surface against the topside of the seat plate or fastening device so that the seating rail does not move further down into the hole in the seat plate, such as a wider form than the extremity which is inserted into the hole in the seat plate between the lining elements 4. The extremity of the children's seating rail may preferably have a vertical extent equal to or longer than the lining elements with locking hooks and a thickness and width which fills the opening defined by the front cross piece 1, the side pieces 2 and the locking hooks 5, as best seen on FIGS. 3 and 4. In this manner, the extremity of the children's seating rail also hinder that the locking hooks 5 may be twisted towards each other after the insertion of the extremity of the children's seating rail and in this manner lock the fastening device 10 to the seat plate. Further, such a shaping will result in the seating rail being well fastened in the seat plate and fastening device 10 and hinder wobble between the parts.

Figure 7:
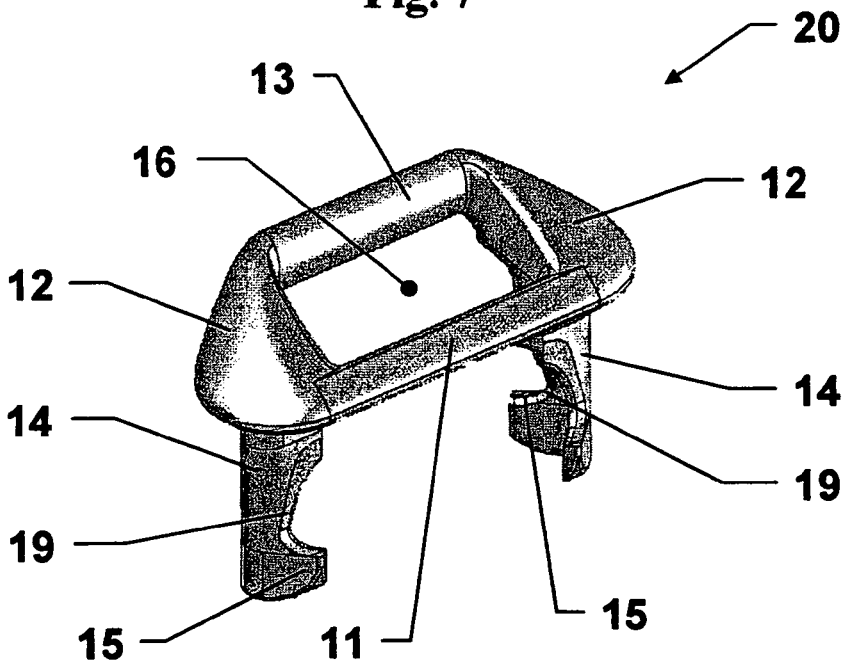
FIG. 7 shows a perspective drawing and a second embodiment of the fastening device seen from above.

In FIG. 7 an alternative embodiment of the fastening device 20 is shown in perspective. In this embodiment each lining element 14 extend into two locking hooks 15 on each of the elements, one directed forward, and one directed backward, both in about 45 degrees from the length or transverse direction. In this case the lining elements 14 comprise flexible zones 19 both on the inside front side and rear side of the lining elements 14, as well as the inside opposing vertical sides, an must be pinched together in order to insert the hooks and lining elements through an oblong hole in a seat plate. Preferably, pincers are used for doing this in such a case. It should be noted that in this embodiment also, an extremity of a children's seating rail, possibly with a snap flap, may be inserted down between the lining elements 14 and the locking hooks 15 and lock the fastening device to the seat plate in that the locking hooks 15 are hindered in being twisted in towards the opening.

Figure 8:
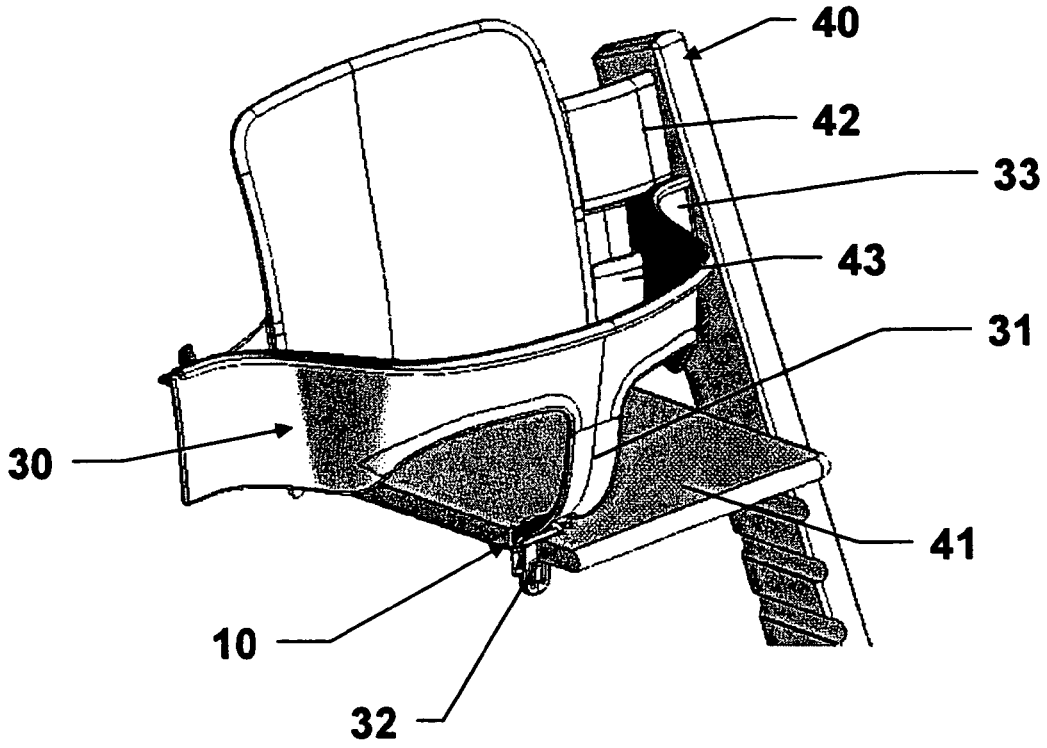
FIG. 8 shows a perspective cut-out of the fastening device in use in a chair with a fastened seating rail.

In FIG. 8 it is shown how a fastening device 10 is placed in a hole in a seat plate 41 in a children's chair 40. The fastening device 10 is adapted to the hole in the seat plate so that the flange with the contact surface 7 has a larger horizontal extent than the area of the opening of the hole and rests on the top side of the seat plate around at least parts of the edges of the hole. The inner opening 6 in the fastening device 10 thereby allows the extremity 32 of a crotch part 31 of the children's seating rail 30 to be guided through the opening 6 and simultaneously through the seat plate 41. A snap flap at the extremity 32 of the seating rail springs out on the underside of the seat plate 41 and attaches the seating rail to the seat plate.

In the example embodiment of FIG. 8, the fastening device is adapted to a seat plate in a Tripp Trapp® chair. The seating rail 30 is in this case adapted by end arms 33 on each side which fit into slits in the side pieces of the chair 40. By this fastening of the seating rail, the seating rail may easily be removed by pressing the snap flap 33 in the extremity and pressing the seating rail from the sides such that one end arm 33 is pressed out of the slit it is inserted. Thus, the chair may be used by an older child or an adult, without the fastening device, which is small and discrete, needing removal.

Hence, the invention also comprises a seating rail set for a children's chair comprising a seating rail with a crotch piece which may be anchored through the fastening device 10 or 20 according to the invention, preferably by end arms which may be slipped into slits on the inside faces of the side pieces of a children's chair.

Besides a children's seating rail which is fastened by the fastening device 10, a children's harness (not shown) may be fastened to the seat plate either alone or in addition, via the fastening device 10, in that a crotch strap may be threaded under the rear cross bar 3 which is positioned above the seat surface of the seat plate and behind the extremity 31 of the children's seating rail 30. The children's harness may be used for further securing the child in the chair, especially against climbing out of the chair.

In the embodiments above, the fastening devices are adapted to a seat plate in a Tripp Trapp® chair. The harness should in such a case be further adapted in that it in addition to being fastened in the seat plate 41 has a back strap which passes around at least one lateral piece 42 or 43 of the back rest in the chair. With this fastening of the harness the child will obtain better freedom of movement compared to traditional children's harnesses. There will also be fewer straps which the child may soil or fasten his fingers into.

Hence, the invention also comprises a harness set for a children's chair comprising a harness with a crotch strap which may be anchored to the bracket fastening device 10 or 20 according to the invention, and at least one strap which runs around at least one lateral piece 42 and/or 43 of the back rest on the chair 40 it is attached to.

Further, the invention comprises a combined seating rail and harness set comprising a harness with a crotch strap and a seating rail with a crotch piece, which both may be fastened via the fastening device 10/20 of the invention to a seat plate in the children's chair.

The advantage with the fastening device and harness set/seating rail set according to the invention is thereby that it may be used on an existing chair, such as the Tripp Trapp® chair or other chairs, without making physical changes on any of the parts of the chair or using fastening means such as screws. The fastening device 10, 20 is locked firmly only by the use of a simple tool, such as pincers, possibly by strong hand force, and the fastening for both harness and/or seating rail follows the adjustments of the chair both vertically and horizontally, such as by height adjustment or depth adjustment of the seat plate, without hindering any of the functions of the chair.

The fastening device renders the detachable fastening of both a harness and a seating rail possible, either separately or together. This provides several practical solutions and makes the use of the chair adaptable to several different users, in a simple and flexible manner. The fastening device may be left mounted in the seat plate without it being of inconvenience for other users or being damaged. As the fastening device only constitutes a small rounded elevation on the seat plate, in an area between the legs which is not weighed down by the user in a normal sitting position, neither the user will be able to bruise himself on the device, nor will the fastening device be exposed to wear, and it will in addition not be aesthetically bothersome.

The fastening device 10, 20 and harness/seating rail set may be removed simply after use or moved to another corresponding chair when they are not needed any more.

The fastening device 10, 20 is preferably produced of a relative rigid material, such as metal, plastic or a composite material, but preferably plastic.

The invention claimed is:

1. A fastening device for a children's chair, the children's chair including a seat plate having a vertical through hole for mounting the fastening device, the fastening device comprising:

at least one cross piece having an underside comprising a surface that defines a horizontal plane, the cross piece connected to two side pieces, the side pieces extending at an angle from the cross piece and defining a plane that is oblique to the horizontal plane, where the side pieces are joined by at least one cross bar such that the cross piece, side pieces, and cross bar define an opening, and wherein the cross bar is positioned at a vertical distance from the cross piece when the fastening device is mounted; and at least two mainly vertical lining elements extending lengthwise between an upper end and a lower end in a vertical direction transverse to the horizontal plane and adapted to be inserted into the through hole, wherein the lining elements are connected at their upper ends to the underside of the cross piece and/or side pieces, and each vertical lining element comprises at its lower end at least one locking hook having a larger horizontal extent than a remainder of the vertical lining elements.

2. The fastening device according to claim 1, wherein the cross piece and the side pieces further comprise a contact surface on the underside of the pieces, wherein each contact surface is adapted to bear against the top side of the seat plate.

3. The fastening device according to claim 1, wherein the fastening device is configured to allow insertion of a crotch strap of a children's seating rail through the opening when the fastening device is mounted in a seat plate.

4. The fastening device according to claim 1, wherein the fastening device is configured to allow a crotch strap of a children's harness to freely run around the cross bar when the fastening device is mounted in a seat plate.

5. The fastening device according to claim 1, wherein the locking hooks are directed partly towards each other.

6. The fastening device according to claim 5, wherein the locking hooks are directed towards each other by about 45 degrees in relation to the length and/or transverse direction of the fastening device.

7. The fastening device according to claim 1, wherein each lining element further comprises flexible zones with reduced rigidness to allow torsion and/or bending of the locking hooks.

8. The fastening device according to claim 7, wherein the flexible zone of each lining element includes a countersink in the lining element.

9. The fastening device according to claim 7, wherein the reduced rigidness is achieved by the lining elements at least partially comprising a more flexible material than the rest of the fastening device.

10. The fastening device according to claim 1, wherein the locking hooks are locked by inserting a part of a seating rail through the opening of the fastening device.

11. The fastening device according to claim 1, wherein the side pieces have an increasing height from the cross piece towards the cross bar.

12. A harness set for a children's chair, the children's chair having a back rest and seat plate with a vertical hole in the front edge, the harness set comprising:

the fastening device according to claim 1; and a children's harness comprising a crotch strap which is anchored in the fastening device.

13. A seating rail set for a children's chair, the children's chair having a back rest and seat plate with a vertical hole in the front edge, the seating rail set comprising:

the fastening device according to claim 1 and a children's seating rail with a crotch piece which is configured to be anchored to the seat plate via an extremity which is configured to be guided through the opening in the fastening device and the hole in the seat plate.

14. A combined harness and seating rail set for a children's chair, the children's chair having a back rest and a seat plate, where the seat plate includes a vertical hole in a front edge of the seat plate; the combined harness and seating rail set comprising:

a harness with a crotch strap;

a seating rail with a crotch piece; and a fastening device configured to be mounted in the vertical hole, including at least one cross piece having an underside comprising a surface that defines a horizontal plane, the cross piece connected to two side pieces, the side pieces extending at an angle from the cross piece and defining a plane that is oblique to the horizontal plane, where the side pieces are joined by at least one cross bar such that the cross piece, side pieces, and cross bar define an opening, and the cross bar is positioned at a vertical distance from the cross piece when the fastening device is mounted; and at least two mainly vertical lining elements extending lengthwise between an upper end and a lower end in a vertical direction transverse to the horizontal plane and adapted to be inserted into the vertical hole, wherein the lining elements are connected at their upper ends to the underside of the cross piece and/or side pieces, and each vertical lining element comprises at its lower end at least one locking hook having a larger horizontal extent than a remainder of the vertical lining elements;

wherein the crotch strap of the harness is configured to be anchored to the fastening device; and the crotch piece of the seating rail is configured to be anchored to the seat plate via an extremity configured to be guided through both the opening in the fastening device and the vertical hole in the seat plate.

15. The fastening device according to claim 2, wherein the contact surface is an open or closed continuous contact surface.

16. The fastening device according to claim 2, wherein the contact surface stretches in a half circle around the outer sides of the lining elements.

17. The fastening device according to claim 3, wherein the fastening device is configured to allow insertion of a portion of a children's seating rail through the opening when the fastening device is mounted in a seat plate, where the insertable portion of the children's seat rail is an extremity with a snap flap which flips out on the underside of the seat plate to which the fastening device is attached.

18. The fastening device according to claim 4, wherein the fastening device is configured to allow a part of a children's harness to freely run around the cross bar when the fastening device is mounted in a seat plate, simultaneously with a part of a children's seating rail being fastened through the fastening device.

19. The fastening device according to claim 11, wherein the side pieces are wedge shaped.

20. The harness set according to claim 12, further comprising a back strap running around at least one cross piece of the back rest in the children's chair it is fastened to.

21. The seating rail set according to claim 13, wherein the extremity includes a snap flap that flips out on the underside of the seat plate, and the children's seating rail more preferably having end pieces which may be inserted into slits in the side pieces of the chair.

22. The seating rail set according to claim 13, wherein the children's seating rail includes end pieces which are configured to be inserted into slits in the side pieces of the chair.

23. A method of mounting a fastening device to a children's chair, where the children's chair includes a seat plate that is adjustable both vertically and horizontally and has a vertical through hole, and the fastening device includes at least one cross piece having an underside comprising a surface that defines a horizontal plane, the cross piece connected to two side pieces, the side pieces extending at an angle from the cross piece and defining a plane that is oblique to the horizontal plane, and the side pieces are joined by at least one cross bar such that the cross piece, side pieces, and cross bar define an opening with the cross bar positioned at a vertical distance from the cross piece; and the fastening device additionally includes at least two mainly vertical lining elements extending lengthwise between an upper end and a lower end in a vertical direction transverse to the horizontal plane and connected at their upper ends to the underside of the cross piece and/or side pieces, each vertical lining element including at its lower end at least one locking hook having a larger horizontal extent than a remainder of the vertical lining elements; the method comprising:

orienting the fastening device above the vertical through hole; and inserting the locking hooks and lining elements into the vertical through hole until the locking hooks extend beyond an undersurface of the seat plate and the fastening device is detatchably fastened to the seat plate.

24. The method of claim 23, further comprising attaching a harness having a crotch strap to the children's chair by anchoring the crotch strap to the fastening device.

25. The method of claim 23, further comprising attaching a seating rail having a crotch piece to the children's chair by inserting an extremity of the crotch piece through both the opening in the fastening device and the vertical through hole in the seat plate, and anchoring it therein.

* * * * *